US008213817B2

(12) United States Patent
Booth et al.

(10) Patent No.: US 8,213,817 B2
(45) Date of Patent: Jul. 3, 2012

(54) TRANSFER PRINT VOLTAGE ADJUSTMENT BASED ON TEMPERATURE, HUMIDITY, AND TRANSFER FEEDBACK VOLTAGE

(75) Inventors: Robert Reed Booth, Lexington, KY (US); Kerry Leland Embry, Midway, KY (US); Paul Wesley Etter, Lexington, KY (US); Claudia Alexandra Marin, Lexinton, KY (US)

(73) Assignee: Lexmark International, Inc., Lexington, KY (US)

( * ) Notice: Subject to any disclaimer, the term of this patent is extended or adjusted under 35 U.S.C. 154(b) by 389 days.

(21) Appl. No.: 12/240,199

(22) Filed: Sep. 29, 2008

(65) Prior Publication Data

US 2010/0080584 A1 Apr. 1, 2010

(51) Int. Cl.
*G03G 15/16* (2006.01)

(52) U.S. Cl. ..... 399/66; 399/44; 399/121; 399/297

(58) Field of Classification Search ..... 399/44, 399/121, 66, 297
See application file for complete search history.

(56) References Cited

U.S. PATENT DOCUMENTS

| | | | | |
|---|---|---|---|---|
| 4,179,213 | A | 12/1979 | Queener | |
| 5,148,218 | A | 9/1992 | Nakane et al. | |
| 5,552,862 | A | 9/1996 | Masuda et al. | |
| 5,678,129 | A | 10/1997 | Yasuda et al. | |
| 5,746,061 | A * | 5/1998 | Kramer | 62/127 |
| 5,786,091 | A | 7/1998 | Kurokawa et al. | |
| 5,799,226 | A * | 8/1998 | Shigeta et al. | 399/66 |
| 6,381,425 | B2 | 4/2002 | Sasai | |
| 6,498,907 | B2 | 12/2002 | Yoda | |
| 6,658,220 | B2 * | 12/2003 | Bessho et al. | 399/44 |
| 6,968,148 | B2 | 11/2005 | Taka et al. | |
| 7,239,833 | B2 | 7/2007 | Tomita et al. | |
| 7,257,358 | B2 | 8/2007 | Overall et al. | |
| 2005/0095023 | A1 * | 5/2005 | Kyung et al. | 399/44 |
| 2005/0158061 | A1 | 7/2005 | Do | |
| 2007/0047988 | A1 * | 3/2007 | Comstock | 399/66 |
| 2007/0077081 | A1 | 4/2007 | Campbell et al. | |
| 2008/0131156 | A1 | 6/2008 | Brockman et al. | |
| 2010/0080585 | A1 | 4/2010 | Booth et al. | |
| 2010/0080586 | A1 | 4/2010 | Booth et al. | |
| 2010/0080587 | A1 | 4/2010 | Booth et al. | |

FOREIGN PATENT DOCUMENTS

| | | | |
|---|---|---|---|
| JP | 11258923 | A * | 9/1999 |
| JP | 2000-330400 | A | 11/2000 |
| JP | 2003-280302 | A | 10/2003 |
| JP | 2008-185705 | A | 8/2008 |

OTHER PUBLICATIONS

Non-Final Office Action for U.S. Appl. No. 12/240,255, entered Mar. 8, 2011.
Notice of Allowance for U.S. Appl. No. 12/240,495, entered Jun. 3, 2011.
Notice of Allowance for U.S. Appl. No. 12/240,255, entered Feb. 6, 2012.

* cited by examiner

*Primary Examiner* — David Gray
*Assistant Examiner* — G. M. Hyder

(57) ABSTRACT

An electrographic image forming device may use a feedback loop to determine environmental conditions and accordingly set one or more operating parameters. The device may detect a resistance/capacitance characteristic of a feedback loop comprising an interface between a first component and a second component of an image forming unit. The device may detect temperature measurements and humidity measurements that can be used to calculate wet-bulb temperature or other metrics used to characterize ambient environmental conditions. The interface may be one in which a toner image is transferred during image forming device operation. A controller may adjust the resistance/capacitance characteristic in response to wet-bulb temperature in conjunction with measured transfer feedback voltage.

20 Claims, 4 Drawing Sheets

| WETBULB TEMPERATURE (°C) | DESCRIPTION | SPEED |
|---|---|---|
| 9.4 | TRANSFER SERVO CORNERS | 35 |
| 11.7 | TRANSFER SERVO CORNERS | 35 |
| 16.8 | TRANSFER SERVO CORNERS | 35 |
| 22.7 | TRANSFER SERVO CORNERS | 35 |
| 24.4 | TRANSFER SERVO CORNERS | 35 |
| | | |
| WETBULB TEMPERATURE (°C) | DESCRIPTION | SPEED |
| 9.4 | PLAIN PAPER PRINTING VOLTAGE | 35 |
| 11.7 | PLAIN PAPER PRINTING VOLTAGE | 35 |
| 16.8 | PLAIN PAPER PRINTING VOLTAGE | 35 |
| 22.7 | PLAIN PAPER PRINTING VOLTAGE | 35 |
| 24.4 | PLAIN PAPER PRINTING VOLTAGE | 35 |

| BLACK TRANSFER OP POINTS | | | | | MAGENTA TRANSFER OP POINTS | | | | |
|---|---|---|---|---|---|---|---|---|---|
| K1 | K2 | K3 | K4 | K5 | M1 | M2 | M3 | M4 | M5 |
| 350 | 600 | 1000 | 1500 | 2500 | 350 | 600 | 1000 | 1500 | 2500 |
| 350 | 600 | 1000 | 1500 | 2500 | 350 | 600 | 1000 | 1500 | 2500 |
| 350 | 600 | 1000 | 1500 | 2500 | 350 | 600 | 1000 | 1500 | 2500 |
| 350 | 600 | 1000 | 1500 | 2500 | 350 | 600 | 1000 | 1500 | 2500 |
| 350 | 600 | 1000 | 1500 | 2500 | 350 | 600 | 1000 | 1500 | 2500 |
| | | | | | | | | | |
| | | | | | | | | | |
| 995 | 1373 | 1782 | 2361 | 3433 | 980 | 1342 | 1900 | 2515 | 3657 |
| 945 | 1323 | 1732 | 2311 | 3383 | 930 | 1292 | 1850 | 2465 | 3607 |
| 895 | 1273 | 1682 | 2261 | 3333 | 880 | 1242 | 1800 | 2415 | 3557 |
| 845 | 1223 | 1632 | 2211 | 3283 | 830 | 1192 | 1750 | 2365 | 3507 |
| 795 | 1173 | 1582 | 2161 | 3233 | 780 | 1142 | 1700 | 2315 | 3457 |

| CYAN TRANSFER OP POINTS | | | | | YELLOW TRANSFER OP POINTS | | | | |
|---|---|---|---|---|---|---|---|---|---|
| C1 | C2 | C3 | C4 | C5 | Y1 | Y2 | Y3 | Y4 | Y5 |
| 350 | 600 | 1000 | 1500 | 2500 | 350 | 600 | 1000 | 1500 | 2500 |
| 350 | 600 | 1000 | 1500 | 2500 | 350 | 600 | 1000 | 1500 | 2500 |
| 350 | 600 | 1000 | 1500 | 2500 | 350 | 600 | 1000 | 1500 | 2500 |
| 350 | 600 | 1000 | 1500 | 2500 | 350 | 600 | 1000 | 1500 | 2500 |
| 350 | 600 | 1000 | 1500 | 2500 | 350 | 600 | 1000 | 1500 | 2500 |
| | | | | | | | | | |
| | | | | | | | | | |
| 1034 | 1466 | 2000 | 2677 | 3711 | 1026 | 1512 | 2100 | 2785 | 3833 |
| 984 | 1416 | 1950 | 2627 | 3661 | 976 | 1462 | 2050 | 2735 | 3783 |
| 934 | 1366 | 1900 | 2577 | 3611 | 926 | 1412 | 2000 | 2685 | 3733 |
| 884 | 1316 | 1850 | 2527 | 3561 | 876 | 1362 | 1950 | 2635 | 3683 |
| 834 | 1266 | 1800 | 2477 | 3511 | 826 | 1312 | 1900 | 2585 | 3633 |

TRANSFER PRINTING VOLTAGES ARE CALCULATED THROUGH INTERPOLATION FROM THE SERVO AND THE WETBULB TEMPERATURE

Fig. 4

TRANSFER PRINT VOLTAGE ADJUSTMENT BASED ON TEMPERATURE, HUMIDITY, AND TRANSFER FEEDBACK VOLTAGE

CROSS REFERENCES TO RELATED APPLICATIONS

None.

BACKGROUND

1. Field of the Invention

The present invention relates generally to electrophotographic imaging devices and, more particularly, to a method of adjusting transfer voltage in an image forming device based on temperature and humidity in conjunction with transfer feedback voltage.

2. Description of the Related Art

An electrophotographic imaging device uses electrostatic voltage differentials to promote the transfer of toner from component to component. In printers using an electrophotographic imaging device, toner is transferred by means of an electrostatic charge from the developer roll to the photo-conductor unit, and then from the photo-conductor unit to the paper. Paper is transported under the photo-conductor unit with a transfer belt. A metal transfer roll coated with a layer of foam sits under the transfer belt. A transfer voltage is applied to this transfer roll in order to move charged toner particles from the photo-conductor unit onto the paper.

The effective transfer of toner within an image forming device is usually dependent on many variables, including environmental conditions such as temperature and humidity. Changes in the temperature and humidity in an environment affect the electrical properties of printer components, which can have a significant impact on print quality.

Previous approaches to improving print quality by adjusting transfer voltage include using dedicated temperature and humidity sensors to detect environmental conditions. These devices may alter operating parameters, such as the transfer bias applied to a transfer member, in response to the detected environmental conditions. Another approach to improving print quality by adjusting transfer voltage includes using measured transfer voltage feedback loops in order to select an appropriate transfer voltage.

A common drawback of these approaches is that temperature and humidity measurements alone are not sufficient to completely characterize the electrical behavior of the system. Further, measured feedback voltages alone cannot adequately distinguish between environmental conditions.

Thus, there is still a need for an innovation that will use measurements from a temperature/humidity sensor in conjunction with measured feedback voltage measurements to adjust the transfer voltage.

SUMMARY OF THE INVENTION

The present invention meets this need by providing an innovation that accounts for temperature and humidity measurements while setting operating parameters in an image forming device in response to periodic feedback loop checks.

Accordingly, in an aspect of the present invention, an electrophotographic image forming device has an image forming unit that may comprise two or more components adapted to transfer a toner image therebetween. Periodically, a sensing unit may detect a resistance/capacitance characteristic of a feedback loop comprising an interface between the components. For example, the detected resistance/capacitance characteristic of the feedback loop may represent a detected voltage produced by passing a known current through the interface between the components. Alternatively, the detected resistance/capacitance characteristic of the feedback loop may represent a detected current produced by passing a known voltage through the interface between the components. A controller may adjust the detected resistance/capacitance in response to wet-bulb temperature values in conjunction with measured transfer feedback. The controller may also adjust the detected resistance/capacitance characteristic in response to the device throughput.

The magnitude of the adjustment may be stored in memory as a lookup table comprising adjustment values corresponding to wet-bulb temperature measurements in conjunction with measured transfer feedback voltage. The wet-bulb temperature is calculated as a function of dry-bulb temperature and relative humidity measurements made by using a temperature sensor and a humidity sensor. Once the adjusted value for the resistance/capacitance characteristic is determined, operating parameters, such as bias voltage applied to a transfer or fuser component may be set.

BRIEF DESCRIPTION OF THE DRAWINGS

Figure 1:
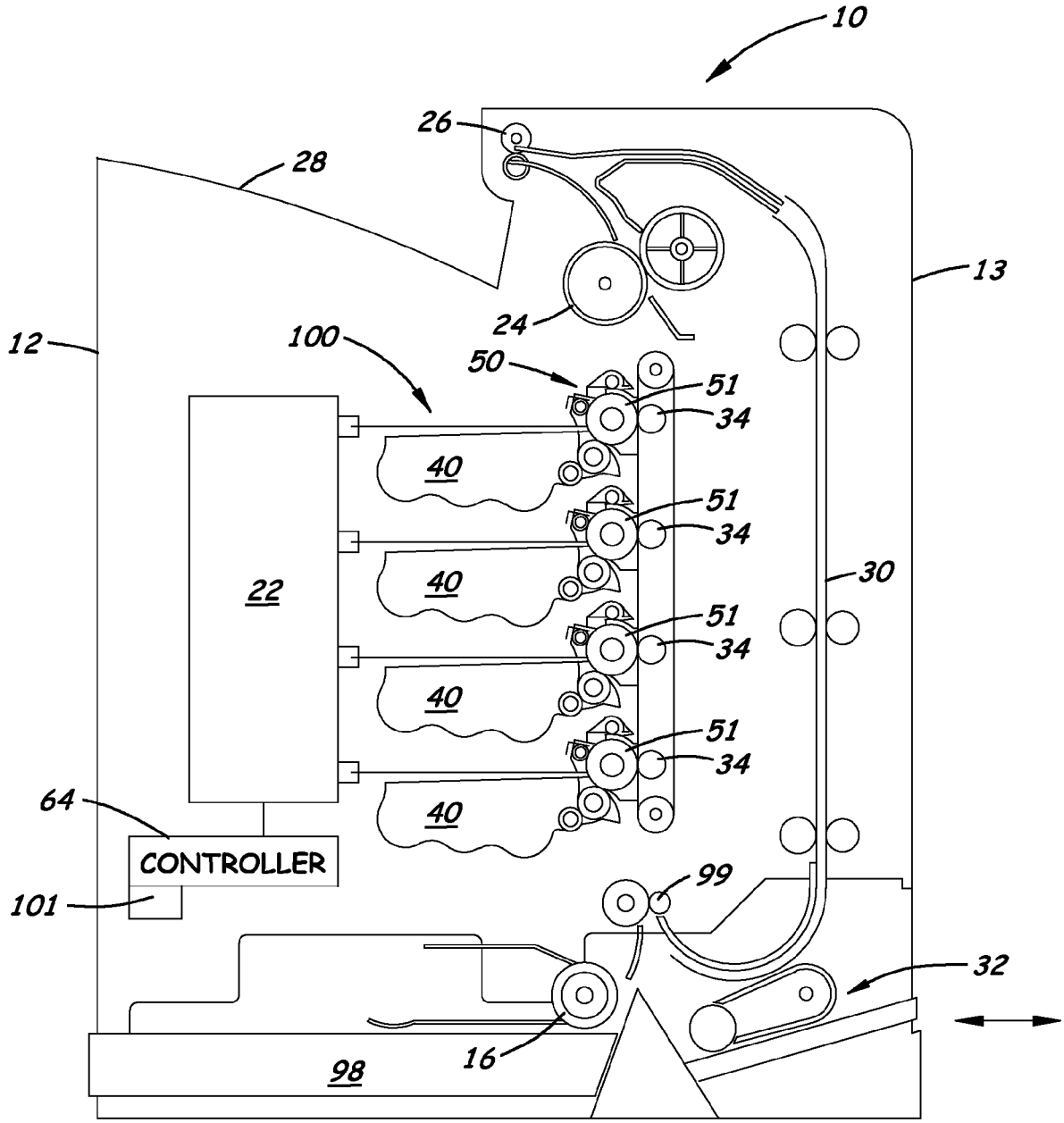

Having thus described the invention in general terms, reference will now be made to the accompanying drawings, which are not necessarily drawn to scale, and wherein:

FIG. 1 is a schematic view of an image forming device according to the present invention.

Figure 2:
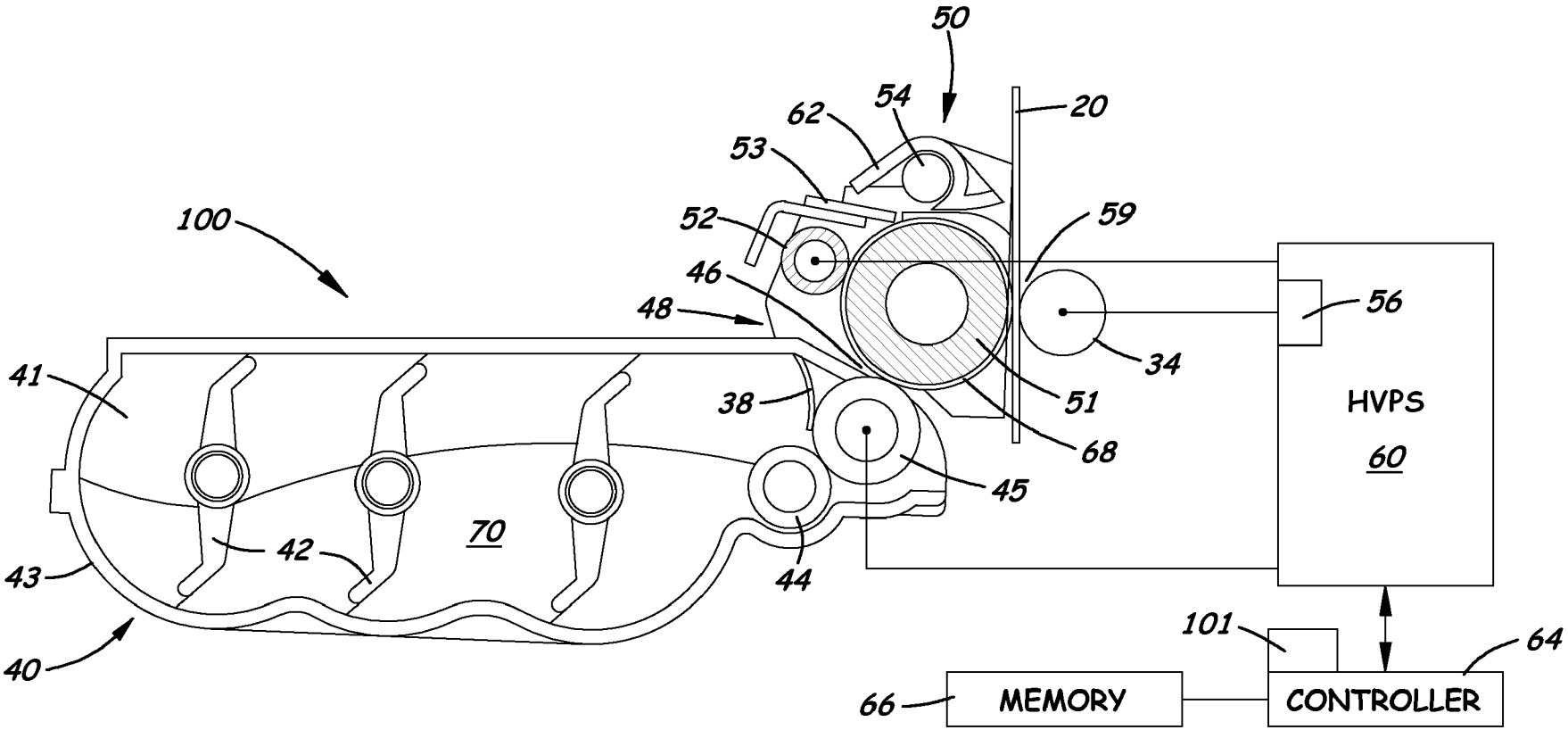

FIG. 2 is a cross-sectional view of an image forming unit and associated power supply and transfer feedback circuit according to one embodiment of the present invention.

Figure 3:
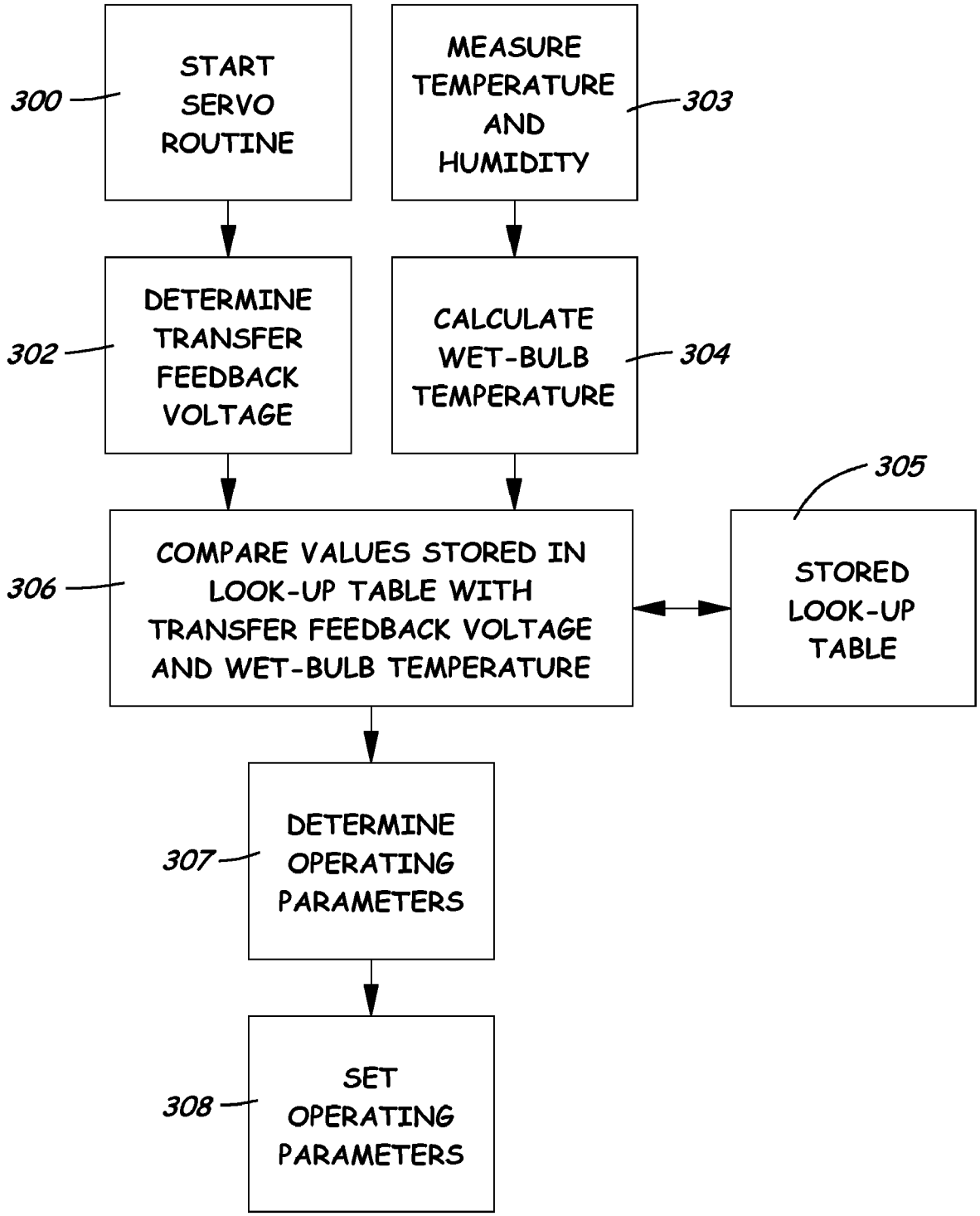

FIG. 3 is a flow diagram illustrating a process by which operating parameters may be adjusted in response to a detected wet-bulb temperature and measured transfer feedback voltage.

FIG. 4 is a representative lookup table (shown separated into three sections at lines X-X and Y-Y) showing transfer print adjustment values for various wet-bulb temperatures and measured transfer feedback voltages according to one embodiment of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is illustrated an image forming device 10. The exemplary image forming device 10 comprises a main body 12 and a door assembly 13. A media tray 98 with a pick mechanism 16, and a multi-purpose feeder 32, are conduits for introducing media sheets into the device 10. The media tray 98 is preferably removable for refilling, and located on a lower section of the device 10.

Media sheets are moved from the input and fed into a primary media path. One or more registration rollers 99 disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow and black toner to produce a four-color image on the media sheet.

An optical scanning device 22 forms a latent image on a photoconductive member 51 within the image forming units 100. The media sheet with loose toner is then moved through a fuser 24 to fix the toner to the media sheet. Exit rollers 26 rotate in a forward direction to move the media sheet to an output tray 28, or rollers 26 rotate in a reverse direction to move the media sheet to a duplex path 30. The duplex path 30 directs the inverted media sheet back through the image formation process for forming an image on a second side of the media sheet.

As illustrated in FIGS. 1 and 2, the image forming units 100 are comprised of a developer unit 40 and a photoconductor (PC) unit 50. The developer unit 40 comprises an exterior housing 43 that forms a reservoir 41 for holding a supply of toner 70. One or more agitating members 42 are positioned within the reservoir 41 for agitating and moving the toner 70 towards a toner adding roll 44 and the developer member 45. The developer unit 40 further comprises a doctor element 38 that controls the toner 70 layer formed on the developer member 45. In one embodiment, a cantilevered, flexible doctor blade as shown in FIG. 2 may be used. Other types of doctor elements 38, such as spring-loaded, ingot style doctor elements may be used. The developer unit 40 and PC unit 50 are structured so the developer member 45 is accessible for contact with the photoconductive member 51 at a nip 46. Consequently, the developer member 45 is positioned to develop latent images formed on the photoconductive member 51.

The exemplary PC unit 50 comprises the photoconductive member 51, a charge roller 52, a cleaner blade 53, and a waste toner auger 54 all disposed within a housing 62 that is separate from the developer housing unit 43. In one embodiment, the photoconductive member 51 is an aluminum hollow-core drum with a photoconductive coating 68 comprising one or more layers of light sensitive organic photoconductive materials. The photoconductive member 51 is mounted protruding from the PC unit 50 to contact the developer member 45 at nip 46. Charge roller 52 is electrified to a predetermined bias by a high voltage power supply (HVPS) 60 that is adjusted or turned on and off by a controller 64. The charge roller 52 applies an electrical charge to the photoconductive coating 68. During image creation, selected portions of the photoconductive coating 68 are exposed to optical energy, such as laser light, though aperture 48. Exposing areas of the photoconductive coating 68 in this manner creates a discharged latent image on the photoconductive member 51. That is, the latent image is discharged to a lower charge level than areas of the photoconductive coating 68 that are not illuminated.

The developer member 45 (and hence, the toner 70 thereon) is charged to a bias level by the HVPS 60 that is advantageously set between the bias level of charge roller 52 and the discharged latent image. In one embodiment, the developer member 45 is comprised of a resilient (e.g., foam or rubber) roller disposed around a conductive axial shaft. Other compliant and rigid roller-type developer members 45 as are known in the art may be used. Charged toner 70 is carried by the developer member 45 to the latent image formed on the photoconductive coating 68. As a result of the imposed bias differences, the toner 70 is attracted to the latent image and repelled from the remaining, higher charged portions of the photoconductive coating 68. At this point in the image creation process, the latent image is said to be developed.

The developed image is subsequently transferred to a media sheet being carried past the photoconductive member 51 by media transport belt 20. In the exemplary embodiment, a transfer roller 34 is disposed behind the transport belt 20 in a position to impart a contact pressure at the transfer nip 59. In addition, the transfer roller 34 is advantageously charged, typically to a polarity that is opposite the charged toner 70 and charged photoconductive member 51 to promote the transfer of the developed image to the media sheet.

The cleaner blade 53 contacts the outer surface of the photoconductive coating 68 to remove toner 70 that remains on the photoconductive member 51 following transfer of the developed image to a media sheet. The residual toner 70 is moved to a waster toner auger 54. The auger 54 moves the waste toner 70 out of the photoconductor unit 50 and towards a waste toner container (not shown), which may be disposed of once full.

In one embodiment, the charge roller 52, the photoconductive member 51, the developer member 45, the doctor element 38 and the toner adding roll 44 are all negatively biased. The transfer roller 34 may be positively charged biased to promote transfer of negatively charged toner 70 particles to a media sheet. Those skilled in the art will comprehend that an image forming unit 100 may implement polarities opposite from these.

A sensor capable of measuring both ambient temperature and relative humidity 101 is mounted directly on a circuit board at the rear of the machine. The controller 64 for this temperature and humidity sensor is also contained within this circuit board.

Periodically, such as between print jobs or at the start of a print job, the HVPS 60, under the control of controller 64, implements a transfer servo routine to determine a transfer feedback voltage that varies in relation to changing operating conditions. The printer controller 64 may adjust operating parameters (e.g., bias voltage applied to the transfer roller 34 or the fuser 24 shown in FIG. 1) based on the determined transfer feedback voltage and wet-bulb temperatures to compensate for changes in operating conditions such as temperature and humidity.

In one embodiment, the transfer feedback voltage that produces a predetermined current through the transfer roller 34 is determined. More specifically, the HVPS 60 includes a sensing circuit 56 adapted to sense the voltage transmitted to the transfer roller 34 that produces a target current of 8 μA. This threshold circuit 56 produces a state change (i.e. low to high transition, otherwise referred to as a positive feedback) in a binary output signal that is sensed by the controller 64 when the transfer current equals or exceeds the target current of 8 μA. If the transfer current remains below the target current, the output of the sensing circuit 56 remains low.

In the exemplary configuration shown and described, the applied current travels through various components, including the transfer roller 34, the media transport belt 20, the photoconductive member 51 and ultimately to the ground. Some of the applied current may also travel to the ground via the cleaner blade 53, charge roller 52, and/or developer member 45. The voltage that produces the target current is referred to as the "transfer feedback voltage." The value of the transfer feedback voltage is transmitted to or otherwise determined by the controller 64. Wet-bulb temperature is transmitted to or otherwise determined by controller 64. Both wet-bulb temperature and transfer feedback voltage are used to determine the appropriate value of the transfer print voltage, which are mapped in memory 66. The controller 64 sets the appropriate transfer voltage for subsequent printing based on the value mapped in memory 66 based on wet-bulb temperature and transfer feedback voltage. FIG. 1 shows that there are four image forming units 100 in the representative image forming device. Accordingly, the process of determining the transfer feedback voltage may be performed for each transfer location in the image forming device 10. In one embodiment, the process is performed simultaneously at each image forming unit 100. Alternatively, the process may be performed sequentially at each image forming unit 100.

Wet-bulb temperature is the temperature of a volume of air that is cooled to saturation at constant pressure by evaporating water into the air without adding or removing heat. A wet-bulb thermometer approximates wet-bulb temperature by measuring the temperature of the tip of the thermometer covered by a wet cloth. When the relative humidity is below 100%, water evaporates from the cloth and effectively cools the tip of the wet-bulb thermometer. Essentially, wet-bulb temperature is a quantity that combines temperature and humidity values into a single value that can be used to differentiate one environmental condition from another. Though temperature and humidity measurements change significantly within the first several minutes of printing, wet-bulb temperature does not change significantly for a given environment, and serves as a quantity that can be used to determine ambient environmental conditions regardless of internal machine temperature. To create a separation between environments, five different wet-bulb temperature ranges were chosen. Each wet-bulb temperature range corresponds to a different transfer table that determines the appropriate print voltage to use for a given transfer servo. Iterative numerical-methods techniques were used to fit a quadratic surface to data taken from the psychrometric chart. The quadratic surface establishes an orthogonal relationship for dry-bulb temperature, relative humidity, and wet-bulb temperature. A best fit quadratic surface to approximate wet-bulb temperature as a function of dry-bulb temperature and relative humidity can be written in the following form:

$$Z=AX^2+BY^2+CXY+DX+EY+F$$

Where:
A=−0.00079
B=−0.00047
C=0.00479
D=0.59473
E=0.10035
F=−6.32789
And:
X=Dry-bulb Temperature (° C.) read from a thermistor
Y=Relative Humidity (% RH)
Z=Wet-bulb Temperature (° C.)

The transfer feedback voltage routines described above have contemplated determining a voltage that results from transmitting a known current through a transfer roller 34. In other embodiments, similar results may be obtained by using a constant current power supply and using a voltmeter to measure the resulting voltage produced when a known current is passed though the image forming unit 100. Similarly, other systems may implement a constant voltage power supply and an ammeter to measure the resulting current produced when a known voltage is transmitted though the image forming unit 100. These alternatives provide different approaches to determining the resistance/capacitance characteristics of the components within the image forming unit 100 that are involved in the transfer of toner particles.

The flow diagram illustrated in FIG. 3 shows one embodiment of a process by which transfer print voltage adjustment may be implemented. In step 300, the transfer servo routine begins. In one embodiment, a sensing circuit 56 (see FIG. 2) is adapted to sense the voltage transmitted to the transfer roller 34 that produces a pre-determined current. The transfer feedback voltage is determined in step 302. Then the controller 64 reads the temperature and humidity measured by sensor 101 in step 303 and based on those readings the wet-bulb temperature value is determined in step 304. The controller 64 (shown in FIG. 2) may store a lookup table as per block 305 for adjusting the transfer print voltage based on wet-bulb temperature values determined in step 304 and transfer print voltage determined in step 302. The controller 64 may read this value from memory 66 as necessary to perform the steps outlined in FIG. 3.

Subsequently, the look-up table value corresponding to the wet-bulb temperature values determined in step 304 and transfer feedback voltage determined in step 302 are used in step the sequence of steps 306-308 to adjust the transfer print voltage.

Lastly, the embodiments described above have contemplated an adjustment to the voltage or current that is measured in response to passing a known test signal though the image forming unit 100. In other embodiments, the operating parameter maps stored in memory 66 may include additional entries reflecting other operating conditions.

Those skilled in the art should also appreciate that the control circuitry associated with controller 64 shown in FIG. 2 for implementing the present invention may comprise hardware, software or any combination thereof. For example, circuitry for initiating, performing, and adjusting the transfer feedback voltage may be a separate hardware circuit, or may be included as a part of other processing hardware. More advantageously, however, the processing circuitry in these devices is at least partially implemented via stored computer instructions for execution by one or more computer devices, such as microprocessors, Digital Signal Processors (DSPs), ASICs or other digital processing circuits included in the controller 64. The stored program instructions may be stored in electrical, magnetic or optical memory devices, such as ROM and RAM modules, flash memory, hard disk drives, magnetic disk drives, optical disc drives and other storage media known in the art.

Furthermore, the exemplary image forming device 10 described herein uses contact-development technology—a scheme that implements a physical contact between components to promote the transfer of toner. The transfer bias adjustment may also be incorporated in image forming devices that use a jump-gap-development technology—a scheme that implements a space between components that are involved in toner development of latent images on the photoconductor. The transfer bias adjustment may be incorporated in a variety of image forming devices including, for example, printers, fax machines, copiers, and multi-functional machines including vertical and horizontal architectures as are well known in the art of electrophotographic reproduction.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. An electrophotographic image forming device comprising:

an image forming unit comprising a first component and a second component disposed to transfer a toner image therebetween;

a first sensing unit operative to detect transfer feedback voltage of a feedback loop comprising an interface between the first component and the second component;

a second sensing unit operative to detect dry-bulb temperature and relative humidity used to calculate wet-bulb temperature therefrom; and a controller operative to adjust transfer voltage bias jointly using both the to wet-bulb temperature measurement and the detected transfer feedback voltage.

2. The device of claim 1 wherein the transfer feedback voltage of the feedback loop is detected by determining a voltage produced by passing a known current through one of the first component or the second component.

3. The device of claim 1 wherein the transfer feedback voltage comprises a resistance-capacitance characteristic of the feedback loop.

4. The device of claim 1 wherein the controller is further operative to adjust the transfer bias in response to a device throughput.

5. The device of claim 1 further comprising a memory device for storing a lookup table comprising adjustment values corresponding to wet-bulb temperature values and measured transfer feedback voltage.

6. The device of claim 1 wherein the wet-bulb temperature is calculated using the following equation:

$$Z=AX^2+BY^2+CXY+DX+EY+F$$

where:

A is about −0.00079;

B is about −0.00047;

C is about 0.00479;

D is about 0.59473;

E is about 0.10035;

F is about −6.32789;

X is the dry-bulb temperature in ° C.;

Y is the relative humidity as a percentage; and

Z is the wet-bulb temperature in ° C.

7. The device of claim 1 wherein the wet-bulb temperature is calculated from temperature sensor measurements and humidity sensor measurements.

8. The device of claim 1 wherein the relative humidity is measured using a humidity sensor.

9. A method of adjusting an operating parameter in an image forming device, the method comprising:

periodically determining a transfer feedback voltage of a feedback loop comprising an interface between a first component and a second component of image forming unit, wherein the transfer feedback voltage of the feedback loop is used in setting an operating parameter for the image forming device;

determining a wet-bulb temperature used in setting an operating parameter for the image forming device;

determining an adjusted transfer voltage bias using both the wet-bulb temperature and the detected transfer feedback voltage; and setting an operating parameter for the image forming device using the adjusted transfer voltage bias;

wherein determining the transfer feedback voltage of the feedback loop comprises determining a voltage required to pass a known current through one of the first or the second component.

10. The method of claim 9 wherein the second component is a transfer member.

11. The method of claim 9 wherein the first component is a photoconductive member.

12. The method of claim 9 wherein the wet-bulb temperature is calculated as a function of dry-bulb temperature and relative humidity.

13. The method of claim 12 wherein the relative humidity is measured using a humidity sensor.

14. The method of claim 9 wherein the wet-bulb temperature is calculated from temperature sensor measurements and humidity sensor measurements.

15. The method of claim 9 wherein the wet-bulb temperature is substantially equal to a calculated value determined by the equation: $Z=-0.00079X^2-0.00047Y^2+0.00479XY+0.59473X+0.10035Y-6.32789$, where X is the dry-bulb temperature in ° C., Y is the relative humidity as a percentage, and Z is the wet-bulb temperature in ° C.

16. A method of adjusting a transfer voltage bias in an image forming device, the method comprising:

periodically measuring a transfer feedback voltage for a feedback loop comprising an interface between a transfer member and a photoconductive member, the transfer feedback voltage determined by passing a known current through the interface between a transfer member and a photoconductive member;

determining a wet-bulb temperature;

storing a set of transfer bias values, each corresponding to different ranges of wet-bulb temperatures and measured transfer feedback voltages;

determining an adjusted transfer feedback voltage based on a transfer bias value that corresponds to both the wet-bulb temperature and the measured transfer feedback voltage; and setting the transfer voltage bias applied to the transfer member during subsequent print jobs using the adjusted transfer feedback voltage.

17. The method of claim 16 wherein the wet-bulb temperature is calculated as a function of dry-bulb temperature and relative humidity which are measured using a temperature sensor and a humidity sensor, respectively.

18. The method of claim 16 wherein determining an adjusted transfer feedback voltage comprises calculating the adjusted transfer feedback voltage using an equation with the measured transfer feedback voltage and the wet-bulb temperature being independent variables.

19. The method of claim 16, wherein determining the adjusted transfer feedback voltage comprises reading the magnitude of feedback voltage transfer adjustment from a lookup table.

20. The method of claim 16 wherein the wet-bulb temperature is determined by the equation: $Z=-0.00079X^2-0.00047Y^2+0.00479XY+0.59473X+0.10035Y-6.32789$, where X is the dry-bulb temperature in ° C., Y is the relative humidity as a percentage, and Z is the wet-bulb temperature in ° C.

* * * * *